US006119581A

United States Patent [19]

Po

[11] Patent Number: 6,119,581

[45] Date of Patent: Sep. 19, 2000

[54] STRUCTURE OF HAND PUMP

[75] Inventor: Tsai Long Po, Tamshui, Taiwan

[73] Assignee: Ho Lee Co., Ltd., Taipei, Taiwan

[21] Appl. No.: 09/204,167

[22] Filed: Dec. 3, 1998

[51] Int. Cl.[7] ..... F01B 31/00

[52] U.S. Cl. ..... 92/58.1; 92/129; 92/165 R

[58] Field of Search ..... 92/58.1, 128, 129, 92/165 R

[56] References Cited

U.S. PATENT DOCUMENTS

| | | | |
|---|---|---|---|
| 4,106,392 | 8/1978 | Johnson, Jr. et al. | 92/128 |
| 4,984,742 | 1/1991 | Ellison et al. | 417/555.1 X |
| 5,005,440 | 4/1991 | Ballu | 74/579 R |
| 5,433,136 | 7/1995 | Lung-Po | 92/58.1 |
| 5,505,338 | 4/1996 | Gueret | 222/95 |
| 5,531,575 | 7/1996 | Lin | 91/422 X |

*Primary Examiner*—John E. Ryznic
*Attorney, Agent, or Firm*—Donald C. Casey, Esq.

[57] ABSTRACT

A hand pump includes a cylindrical casing having a top open side covered with a top cover and a bottom side provided with an air outlet, a handle inserted through a hole the top cover, and a piston moved with the handle up and down to pump air out of the cylindrical casing through the air outlet, wherein the handle has multiple peripheral sides and angles defining a plurality of longitudinal grooves equiangularly spaced around the periphery for guiding outside air into the cylindrical casing evenly upon an up stroke of the handle, and a wedge-like coupling rod at a bottom end thereof press-fitted into a coupling hole at the piston for enabling the piston to be reciprocated with the handle.

5 Claims, 3 Drawing Sheets

STRUCTURE OF HAND PUMP

BACKGROUND OF THE INVENTION

The present invention relates to a hand pump, and more specifically to an improved structure of handle pump which is durable in use, and which can easily be assembled.

A regular hand pump as shown in FIG. 1, comprises a cylindrical casing 10 having an air outlet 11 at its closed bottom end, a top cover formed of two symmetrical cover plates 12 and 13 and covered on the top opening of the cylindrical casing 10, a handle 20 inserted through the center hole at the top cover of the cover plates 12 and 13, a piston 22 fixedly fastened to the bottom end of the handle 20 by a lock nut 23 and moved up and down inside the cylindrical casing 10, and an O-ring 221 mounted on the periphery of the piston 22 and disposed in contact with the inside wall of the cylindrical casing 10. The handle 20 has a recessed chamber 24 at its top side, which is covered with a cap 26 to hold a needle nozzle 25 on the inside, and two longitudinal deep grooves 21 bilaterally disposed along its length. When pulling the handle 20. upwards, air passes through the longitudinal deep grooves 21 into the inside of the cylindrical casing 10, enabling the handle 20 to be conveniently pulled up. This structure of hand pump has drawbacks. Because the longitudinal deep grooves 21 have a certain depth, the handle 20 tends to be forced to bend due to a concentration of stress. Another drawback of this structure of hand pump is that the longitudinal deep grooves 21 can not guide in sufficient air when the handle 20 is pulled upwards in a rush, and the piston 22 will receive a downward pressure when moved upwards. Still another drawback of this structure of hand pump is that a hand tool must be used when fastening the lock screw 23 to the handle 20 to fix the piston 22 and the handle 20 together. Furthermore, the installation of the cover plates 12 and 13 is also complicated.

SUMMARY OF THE INVENTION

The present invention has been accomplished to provide a hand pump, which eliminates the aforesaid drawbacks. According to one aspect of the present invention, the hand pump comprises a casing, a handle, and a piston reciprocated by the handle in the casing to pump air out of an air outlet at the bottom side of the casing, wherein the handle has multiple peripheral sides and angles defining a plurality of longitudinal grooves equiangularly spaced around the periphery for guiding outside air into the cylindrical casing of the hand pump evenly upon an up stroke of the handle. According to another aspect of the present invention, the casing has a top open side covered with an integrated top cover, which has a center through hole through which the handle passes. According to still another aspect of the present invention, the handle and the piston are fastened together by press-fitting a wedge-like coupling rod at the handle into a coupling hole at the piston.

DETAILED DESCRIPTION OF THE PREFERRED EMBODIMENT

Figure 3:
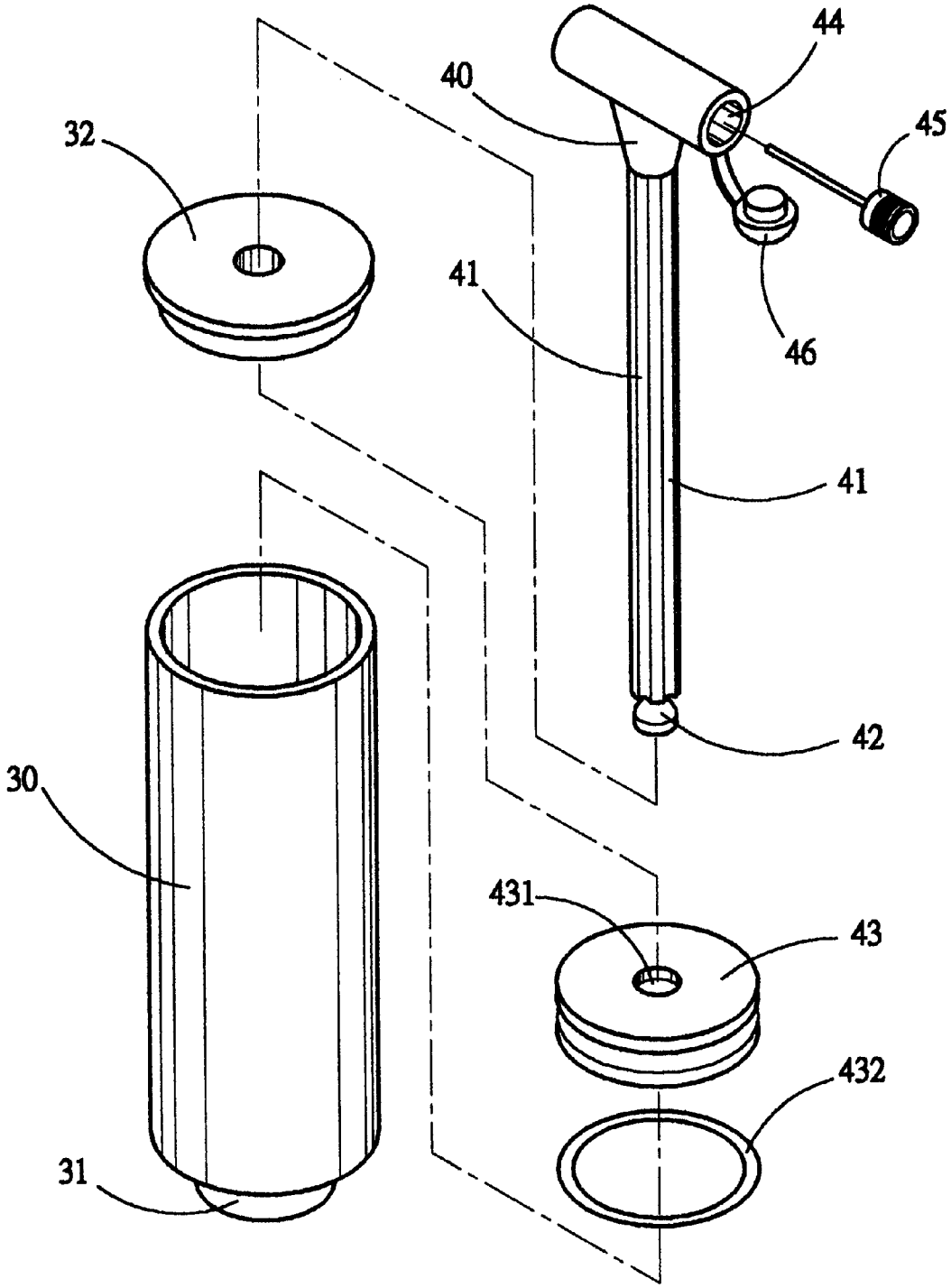
FIG. 3 is an exploded view of a hand pump according to the present invention.

Referring to FIG. 3, a hand pump is shown comprised of a cylindrical casing 30, a handle 40, and a piston 43.

The cylindrical casing 30 has an air outlet 31 at its closed bottom side. The top side of the cylindrical casing 30 is an opening, which is covered with a top cover 32. The top cover 32 is an integrated member fixedly secured to the cylindrical casing 30 and covered on the opened top side of the cylindrical casing 30. The handle 40 is inserted through the center hole at the top cover 32 into the inside of the cylindrical casing 30. The piston 43 is coupled to the bottom end of the handle 40, and moved with the handle 40 up and down in the cylindrical casing 30 to pump air out of the cylindrical casing 30 through the air outlet 31. The piston 43 has a coupling hole 431 at the center of its top side wall for coupling to the handle 40. An O-ring 432 is mounted on the grooved peripheral wall of the piston 43, and maintained in close contact with the inside wall of the cylindrical casing 30.

Figure 1:
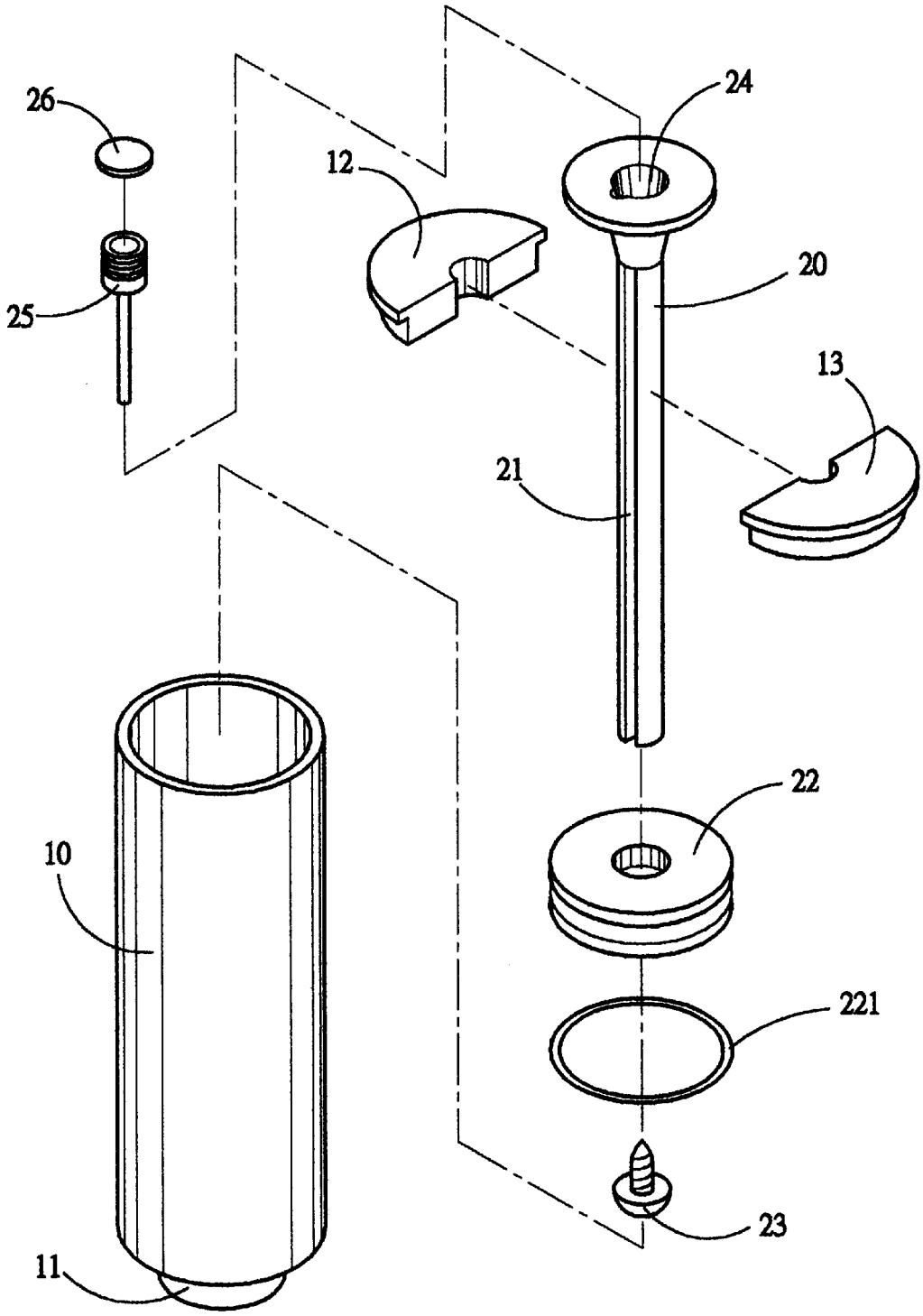
FIG. 1 PRIOR ART
FIG. 1 is an exploded view of a hand pump according to the prior art.
Figure 2:
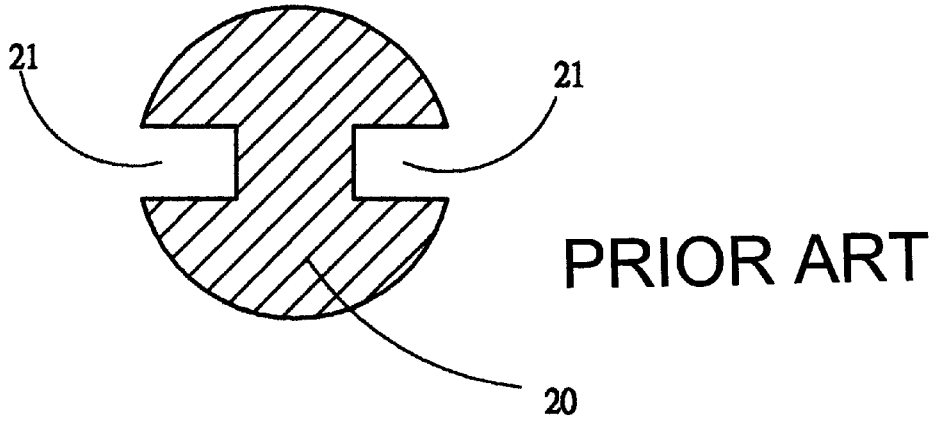
FIG. 2 is a cross sectional view in an enlarged scale of the handle of the hand pump shown in FIG. 1.
Figure 4:
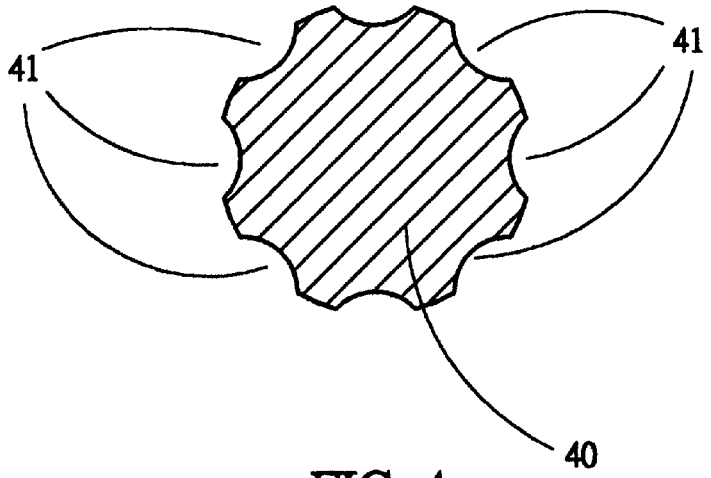
FIG. 4 is a cross sectional view in an enlarged scale of the handle of the hand pump shown in FIG. 3.

Referring to FIG. 4 and FIG. 3 again, the handle 40 has a wedge-like coupling rod 42 at its bottom end press-fitted into the coupling hole 431 at the piston 43, a transverse receiving chamber 44 at its transverse top, which receives a needle nozzle 45, a hinged cap 46 for closing the transverse receiving chamber 44, and multiple peripheral sides and angles defining a plurality of longitudinal grooves 41 equiangularly spaced around the periphery. Because the handle 40 has a plurality of longitudinal grooves 41 equiangularly spaced around the periphery, air is envenly guided into the cylindrical casing 30 upon an up stroke of the handle 40. Therefore, the handle 40 can be smoothly reciprocated to pump air out of the cylindrical casing 30 through the air outlet 31. Because the piston 43 and the handle 40 are fastened together by press-fitting the wedge-like coupling rod 42 of the handle 40 into the coupling hole 431 at the piston 43, installation of the piston 43 can easily be achieved without the use of a hand tool. Furthermore, because the top cover 32 is an integrated member, it can be conveniently fastened to the cylindrical casing 30 to seal the top open side of the cylindrical casing 30.

What the invention claimed is:

1. A hand pump comprising a cylindrical casing, said cylindrical casing having a top open side, a closed bottom side, and an air outlet at the closed bottom side, a top cover covered on the top open side of said cylindrical casing, a handle, said handle having a bottom end inserted through a center hole at said top cover into said cylindrical casing and a top end disposed outside said cylindrical casing, and a piston coupled to the bottom end of said handle and reciprocated with said handle to pump air out of said cylindrical casing through said air outlet, wherein said handle comprises multiple peripheral sides and angles defining a plurality of longitudinal grooves equiangularly spaced around the periphery thereof for guiding outside air into said cylindrical casing evenly at different sides through the center hole at said top cover upon an up stroke of said handle wherein two adjacent grooves of the equiangularly spaced grooves have a spacing of less then 180 degrees.

2. The hand pump of claim 1 wherein said piston has a coupling hole at the center of a top side wall thereof for coupling to said handle; said handle has a wedge-like coupling rod at its bottom end press-fitted into the coupling hole at said piston.

3. The hand pump of claim 1 wherein said top cover is an integrated member fixedly fastened to said cylindrical casing to seal the open top side of said cylindrical casing.

4. The hand pump of claim 1, in which the number of equiangularly spaced grooves is greater than two.

5. The hand pump of claim 1, in which the equiangularly spaced grooves have a hemispherical cross-sectional shape.

* * * * *